US009238925B2

(12) United States Patent
Weinerman et al.

(10) Patent No.: US 9,238,925 B2
(45) Date of Patent: Jan. 19, 2016

(54) LATCH ASSEMBLY

(71) Applicant: The Eastern Company, Cleveland, OH (US)

(72) Inventors: Lee S. Weinerman, Medina, OH (US); Reese Bernot, Cleveland, OH (US)

(73) Assignee: The Eastern Company, Cleveland, OH (US)

( * ) Notice: Subject to any disclaimer, the term of this patent is extended or adjusted under 35 U.S.C. 154(b) by 276 days.

(21) Appl. No.: 13/773,018

(22) Filed: Feb. 21, 2013

(65) Prior Publication Data

US 2014/0210222 A1 Jul. 31, 2014

Related U.S. Application Data

(60) Provisional application No. 61/759,094, filed on Jan. 31, 2013.

(51) Int. Cl.

| | |
|---|---|
| ***E05B 7/00*** | (2006.01) |
| ***E05B 63/00*** | (2006.01) |
| ***E05B 17/00*** | (2006.01) |

(52) U.S. Cl.

CPC ..... *E05B 7/00* (2013.01); *E05B 17/0004* (2013.01); *E05B 63/00* (2013.01); *Y10T 29/49826* (2015.01); *Y10T 292/48* (2015.04)

(58) Field of Classification Search

CPC ..... E05B 1/0061; E05B 7/00; E05B 17/002; E05B 17/0041; E05B 17/0045; E05B 17/007; E05B 77/34

USPC ..... 292/336.3, DIG. 31, 118, 126, 100, 161, 292/173, 143, 217, 226, 200, 216; 70/208; 277/630, 637

See application file for complete search history.

(56) References Cited

U.S. PATENT DOCUMENTS

| | | | | | |
|---|---|---|---|---|---|
| 2,706,656 | A | * | 4/1955 | Roubal | 411/301 |
| 2,763,503 | A | * | 9/1956 | Tasch et al. | 292/173 |
| 2,982,573 | A | * | 5/1961 | McKee, Jr. | 411/542 |
| 3,160,054 | A | * | 12/1964 | Cohen et al. | 411/371.1 |
| 3,168,321 | A | * | 2/1965 | Glicksman | 277/637 |
| 3,555,168 | A | * | 1/1971 | Frykberg | 174/374 |
| 3,917,292 | A | * | 11/1975 | Martin | 277/328 |
| 3,993,338 | A | * | 11/1976 | Cherbourg et al. | 292/336.3 |
| 4,309,884 | A | * | 1/1982 | Davis | 70/472 |
| 4,706,478 | A | | 11/1987 | Swan et al. | |
| 5,299,844 | A | * | 4/1994 | Gleason | 292/240 |
| 5,526,660 | A | * | 6/1996 | Bennett et al. | 70/208 |
| 5,586,458 | A | * | 12/1996 | Weinerman et al. | 70/208 |
| 5,595,076 | A | * | 1/1997 | Weinerman et al. | 70/208 |
| 5,611,224 | A | * | 3/1997 | Weinerman et al. | 70/208 |

(Continued)

*Primary Examiner* — Alyson M Merlino

(74) *Attorney, Agent, or Firm* — Ralph E. Jocke; Walker & Jocke

(57) ABSTRACT

A water seal system is provided for a latch assembly that comprises a housing having a receptacle in which a handle extends therein. A trigger extends from the handle through an aperture in the receptacle to a latching mechanism on a rear side of the housing. The trigger is operative to cause the latching mechanism to operate, responsive to movement of the handle. The water seal system includes a gasket mounted to a metal backing plate, with slots extending through the backing plate and gasket. The trigger extends through the slots such that the backing plate abuts a stop surface of the trigger. Movement of the handle from the extended position to the retracted position is operative to cause the stop surface to urge the backing plate to compress the gasket adjacent portions of the receptacle that extend around the aperture.

25 Claims, 3 Drawing Sheets

(56) References Cited

U.S. PATENT DOCUMENTS

| | | | | |
|---|---|---|---|---|
| 5,884,948 | A * | 3/1999 | Weinerman et al. | 292/216 |
| 5,927,773 | A * | 7/1999 | Larsen et al. | 292/337 |
| 5,984,383 | A | 11/1999 | Parikh et al. | |
| 6,095,573 | A * | 8/2000 | Rozema | 292/51 |
| D459,192 | S | 6/2002 | Weinerman et al. | |
| 6,418,761 | B1 | 7/2002 | Wytcherley et al. | |
| 6,474,654 | B1 * | 11/2002 | Schmeichel | 277/630 |
| 6,490,895 | B1 * | 12/2002 | Weinerman et al. | 70/208 |
| 6,513,353 | B1 | 2/2003 | Weinerman et al. | |
| 6,595,525 | B2 * | 7/2003 | Schmidt | 277/630 |
| 6,623,052 | B2 | 9/2003 | Hansen | |
| 6,651,467 | B1 * | 11/2003 | Weinerman et al. | 70/208 |
| D489,957 | S | 5/2004 | Lane | |
| 6,736,406 | B1 * | 5/2004 | Provencher | 277/628 |
| D533,048 | S | 12/2006 | Weinerman et al. | |
| D590,694 | S | 4/2009 | Stuckey | |
| D624,803 | S | 10/2010 | Frankham et al. | |
| D638,276 | S | 5/2011 | Tonizzo et al. | |

* cited by examiner

LATCH ASSEMBLY

BACKGROUND

Latch assemblies are mechanical apparatuses that are typically used to releasably hold/latch two elements in closed relation. For example, latch assemblies may be used to hold/latch a closure member such as a door or hatch in a closed position relative to a body member such as a door frame or hatch frame. Such latch assemblies are also operative to release/unlatch the closure member relative to the body member via mechanical manipulation of a portion of the latch assembly such as a handle. Latch assemblies may benefit from improvements.

SUMMARY

The following is a brief summary of subject matter that is described in greater detail herein. This summary is not intended to be limiting as to the scope of the claims.

In example embodiments of one or more inventions described herein, a latch assembly may include a water seal system that is operative to minimize water intrusion to the back side of the latch assembly. Examples of latch assemblies that may include embodiments of the water seal system described herein include paddle handle latches. An example of a paddle handle latch is shown in U.S. Pat. No. 6,513,353, which is incorporated by reference herein in its entirety.

Such latches typically include a handle nested in a housing-defined receptacle, which handle pivots so as to move a linkage which is referred to herein as a trigger. Such a trigger may extend from the handle through an aperture in the base of the receptacle of the housing and engage with a latching mechanism mounted on a rear side of the housing. Such a latching mechanism may be operative responsive to the movement of the trigger to unlatch a closure member (e.g. a door/hatch) with respect to a body member (e.g. a door/hatch frame). For example, such a latching mechanism may include a rotary latch that is operative to engage with a striker of closed door. Movement of the handle is operative to move the trigger so as to cause the latching mechanism to release the striker and permit the door to open. Also, it should be appreciated that example embodiments of the described water seal system may be used with other forms and styles of latch assemblies which include a handle operated trigger.

An example embodiment of the water seal system includes the previously described trigger that is welded to (or otherwise fastened) to the handle. Mounted on this trigger is a deformable gasket mounted to a rigid backing plate. In an example embodiment the gasket may be attached to the backing plate via an adhesive (e.g., a pressure sensitive adhesive). In an example embodiment the backing plate may be comprised of a stainless steel or other type of metal that is operative to resist oxidation and/or that is coated in a manner that resists oxidation. The gasket may be comprised of a compressible water resistant material such as a neoprene or other synthetic rubber and/or any other type of material that is deformable and is operative to minimize water leakage between adjacent elements when compressed.

In an example embodiment, the backing plate and gasket include slots therethrough. The backing plate and gasket are mounted to the trigger by extending an end portion of the trigger through the slots. The trigger may include at least a stop surface (e.g., a ledge or shoulder) that is operative to receive the backing plate in abutting relation thereagainst, with the gasket facing towards the top of end portion of the trigger. This described water seal system operates by causing the stop surface to urge the backing plate so as to compress the gasket between the backing plate and the portions of the receptacle that surround the aperture through which the trigger extends. This compression seals the outward facing side of the receptacle from water intrusion to the back side of the receptacle.

In an example embodiment, the water seal system may be assembled on a latch apparatus via a method in which the backing plate (absent the gasket) is initially mounted on the trigger by relatively sliding the end of the trigger through the slot of the backing plate, until the backing plate rests on the stop surface of the trigger. The gasket may be provided with a pressure sensitive adhesive that is covered with a cover/liner. The cover/liner may be removed to expose the pressure sensitive adhesive and subsequently the gasket may be mounted on the backing plate (already on the trigger) by relatively sliding the end of the trigger through the slot of the gasket, until the side of the gasket with the pressure sensitive adhesive becomes pressed against the backing plate. The trigger may then be slid through the aperture in the receptacle of the housing, so as to extend to the back side of the latch assembly.

Other aspects will be appreciated upon reading and understanding the attached figures and description.

DETAILED DESCRIPTION

Figure 1:
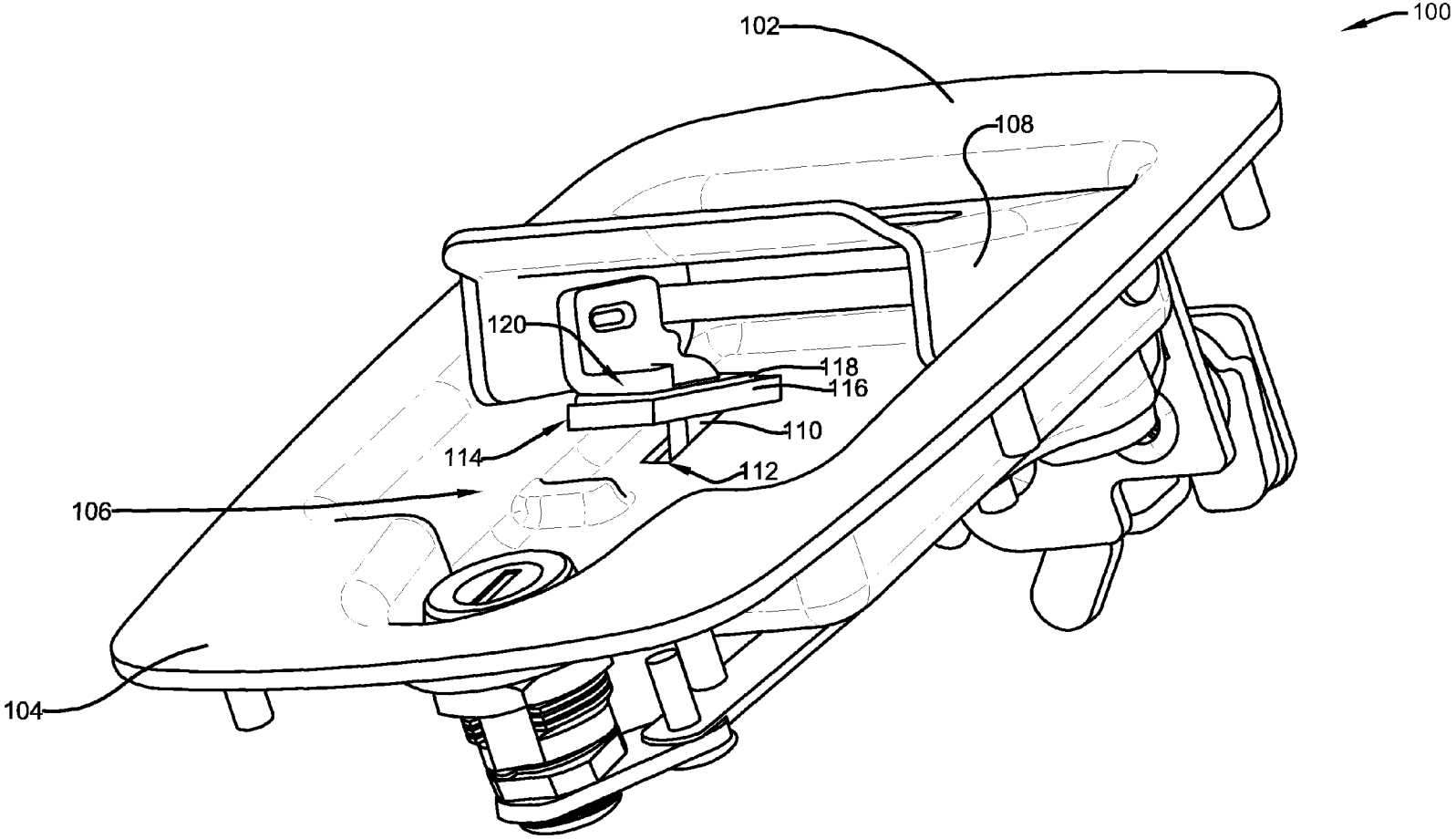
FIG. 1 is a front perspective view of an example latch assembly.

Various technologies pertaining to a water seal system for a latch assembly will now be described with reference to the drawings, where like reference numerals represent like elements throughout. Also, it is to be understood that functionality that is described as being carried out by certain components may be performed by multiple components. Similarly, for instance, a component may be configured to perform functionality that is described as being carried out by multiple components.

With reference to FIG. 1, an example embodiment 100 of a latch assembly 102 is illustrated. In this example the latch assembly 102 corresponds to a paddle handle latch. However, it should be noted the features described herein for the latch assembly 102 may be used on other types of latch assemblies that include pivotal handles.

Figure 2:
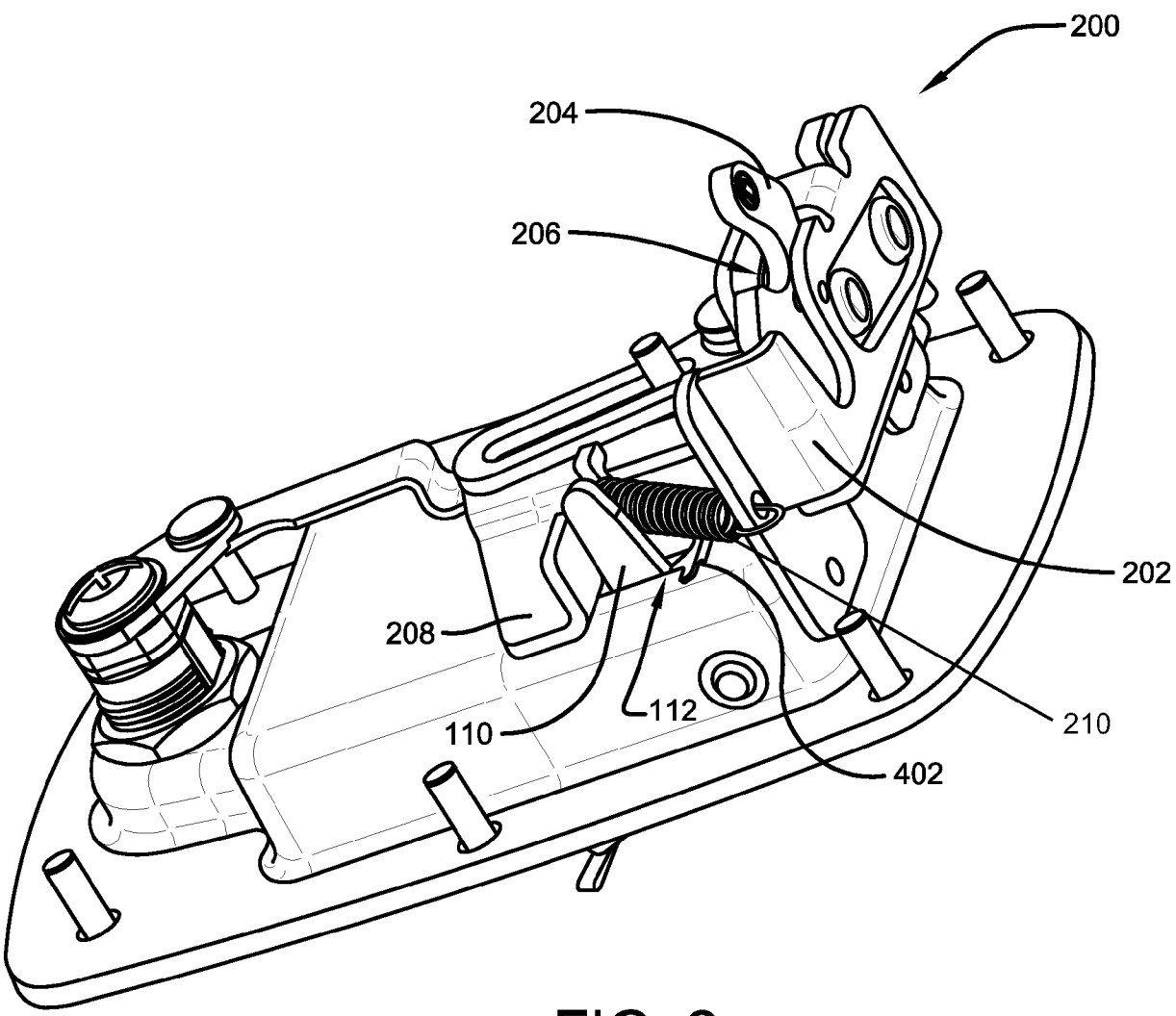
FIG. 2 is a rear perspective view of the example latch assembly.

The latch assembly 102 includes a housing 104 which includes a receptacle 106 for a pivotal handle 108. The handle 108 is operative to pivot between a retracted position and an extended position relative to the receptacle, wherein in the extended position, the handle extends relatively farther out of the receptacle than when in the retracted position. FIG. 1, shows the handle 108 is an intermediate position between the retracted and extended positions. Pivoting of the handle 108 is operative to cause a latching mechanism mounted on the rear side of the housing to operate. FIG. 2 illustrates an example 200 of portions of a latching mechanism 202 on a rear side of the housing 104. Such a latching mechanism for example may include a rotary latch 204 (or other configuration of a latching mechanism depending on the desired functionality of the latch assembly). FIG. 2 shows an example of the rotary latch 204 in an unlatched position. Such a rotary latch is operative to rotate downwardly to a latched positioned that is operative to hold a striker (not shown) in a "U" shaped notch 206 of the rotary latch 204.

The described latching mechanism may be configured such that when a lower portion of the handle 108 (shown in FIG. 1) is manually lifted (by a user), a trigger 110 connected to the handle 108 is operative to cause the latching mechanism (on the rear side of the assembly) to unlatch an engaged striker (e.g., by causing the rotary latch to rotate upwardly to the position shown in FIG. 2). As shown in FIG. 1, the trigger extends through an aperture 112 through the receptacle 106 so as to extend from the handle positioned on a front side of housing into engagement with portions of the latching mechanism positioned on the rear side of the housing.

As illustrated in FIG. 2, in this example embodiment the trigger 110 extends through the aperture 112 and is operative to engage a linkage 208. The pivoting of the handle (from the retracted to the extended position) is operative to cause the trigger to urge the linkage 208 to move in a direction that causes the latching mechanism to change to its unlatched configuration. In this example, the linkage 208 may be operative to urge a rotary pawl to move so as to permit the rotary latch 204 to rotate. A spring included in the latching mechanism may then urge the rotary latch 204 to rotate to the position shown in FIG. 2. Also as shown in FIG. 2, the latch assembly may also include a spring 210 that is operative to pull the linkage 208 towards the trigger 110. Such an arrangement may urge the trigger to move the handle to its retracted position.

Also it should be appreciated that although a latching mechanism is shown that includes a rotary latch, it should be understood that the embodiments described herein may be used with other forms of latching mechanism that are capable of being operative via the described trigger. Other latching mechanism may include various linkages, rods, and brackets that are operative to manipulate one or more latching elements (including movable bolts) positioned adjacent to and/or remote from the described housing of the latch assembly.

In a typical implementation of the described latch assembly, the latch assembly may be mounted to a door, hatch or other closure member in a manner in which the front side of the assembly can be exposed to rain, snow, ice, washings, and other sources of water. As shown in FIG. 1, in order to minimize the opportunity for water reaching an internal portion of the closure member, an example embodiment of the described latch assembly may include a water seal system 114. Such a water seal system may be operative to resist water passing through the aperture 112, when the handle is in its retracted position (nestled in the housing receptacle 106).

Figure 3:
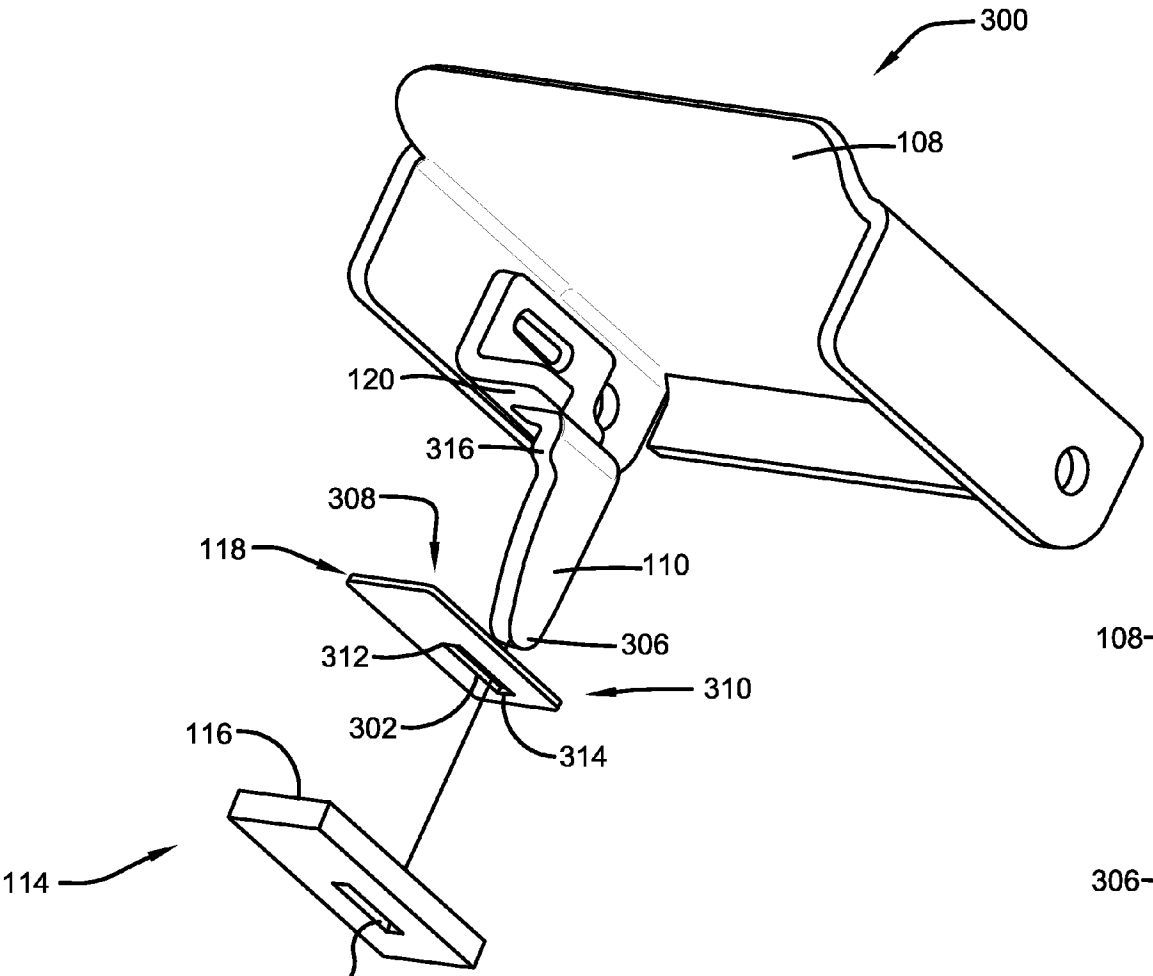
FIG. 3 is an exploded view of a portion of the example latch assembly.

As shown in FIG. 1, in an example embodiment, the water seal system may include a gasket 116, a backing plate 118, and a stop surface 120. FIG. 3, illustrates an exploded view 300 of the water seal system 114. Both the backing plate and the gasket may include slots 302, 304 to enable them to be slid on the trigger 110 (with an end portion 306 of the trigger sliding through the slots 302, 304). As shown in FIG. 3, the backing plate 118 may be mounted first on the trigger, with the gasket 116 mounted second, such that the gasket 116 is closer to a tip of the end portion 306 of the trigger than the backing plate. In this example a first end portion 308 of the backing plate may extend from a first end 312 of the slot 302 a distance (in the longitudinal direction of the slot) that is greater than the distance that the opposed second end 310 of the backing plate extends from an opposed end 314 of the slot (in the longitudinal direction of the slot).

Figure 4:
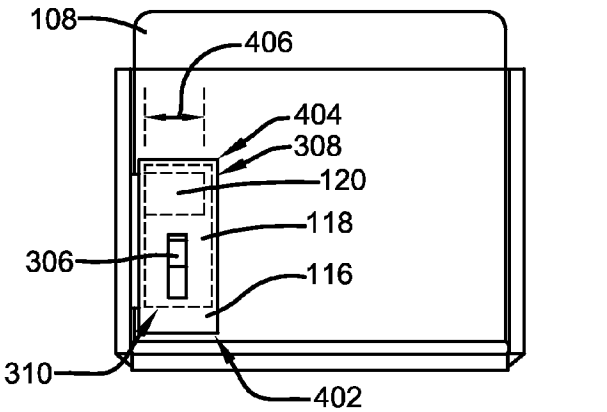
FIG. 4 is a bottom inside view of a handle of the example latch assembly.

FIG. 4 illustrates a bottom (inside) view 400 of the handle that also shows the relative dimensions and orientations of the backing plate 118, gasket 116, and stop surface 120. As shown in FIG. 4, the gasket 116 may have a length and width that is larger than the backing plate. In addition, in an example embodiment, the stop surface 120 may also have a length 406 that extends across more than half of a width of the backing plate 118 and gasket 116 adjacent the first end 308 of the backing plate. In addition, as shown in FIG. 3, the gasket 116 may have a greater thickness than the backing plate 118.

As illustrated in FIG. 4, the second end 402 of the gasket may extend a greater distance from the second end 310 of the backing plate, than a first end 404 of the gasket extends from the first end 308 of the backing plate (in a longitudinal direction of the slot). The additional length of the second end 402 of the gasket may be sufficiently long to continue to cover at least portions of the aperture 112 through the receptacle as the trigger moves in the aperture responsive to pivoting of the handle 108 in the receptacle from the retracted position to the extended position. In addition, as shown in FIG. 2, the aperture 112 may be configured to receipt a portion of the second end 402 of the gasket therein. For example, the aperture may have a generally "T" shape, with an upper portion that is relatively wider than a lower portion. In this example the upper portion is wider than the width of the second end 402 of the gasket in order to be operative to receive at least a portion of the second end 402 therein.

As shown in FIG. 3, in an example embodiment the stop surface 120 may correspond to a shoulder of the trigger that is operative to receive the first end portion 308 of the backing plate in abutting relation therewith. In this example the shoulder may be formed by bending a portion of the same piece of metal that forms the trigger in a direction that is generally perpendicular to the direction that the first end 306 of the trigger 110 extends through the slots of the backing plate and the gasket. However, it should also be appreciated that in further embodiments, the stop surface may correspond to a portion of the handle and/or a third element that is mounted to the trigger and/or the handle, which stop surface has an orientation operative to abut the backing plate as described herein.

As discussed previously, FIG. 1 shows the handle in an intermediate position between its extended and retracted positions. In an example embodiment, a portion 316 of trigger has a cross-sectional shape that is operative to fit sufficiently tight through at least one of the slots 302, 304, to lock and maintain the backing plate and gasket in place and in abutting engagement with the stop surface 120, when the handle 108 is moved upwardly from the retracted position. Also, as can be appreciated, when the handle 108 moves downwardly from the extended position to the retracted position, the stop surface is operative to urge the backing plate to compress the gasket adjacent portions of the receptacle that extend around the aperture 112 in the base of the receptacle.

In an example embodiment, the gasket may be mounted to the backing plate with a pressure sensitive adhesive. However, it should be appreciated that in alternative embodiments other forms of adhesives may be used that are operative to adhere a deformable gasket material to a backing plate. Also it should be appreciated that in further embodiments the gasket may not be adhesively mounted to the backing plate. In such embodiments, the gasket may have a sufficiently tight compression fit with the trigger through its slot, that the gasket is operative to hold itself and the backing plate adjacent the stop surface.

In an example embodiment the backing plate may be comprised of a sufficiently rigid material such as a metal that will not bend or degrade after many thousands of cycles of operating the handle. The backing plate may also be comprised of a metal that is resistant to oxidization such as a stainless steel. However, it should be appreciated that in alternative embodiments other metals or materials may be used. Further it should be appreciated that the backing plate may be coated with paint or other coating that is operative to minimize oxidation of the backing plate.

In an example embodiment, the gasket may be comprised of a deformable material such as a synthetic rubber or other material that is operative to compress and form a generally water tight seal between the trigger and the portions of the receptacle around the aperture through the receptacle. For example, the gasket may be comprised of a neoprene or other synthetic rubber, or other type of water resistant gasket material.

An example methodology of producing or replacing the described water seal system may include a series of steps. Such steps may include providing the previously described trigger such that the end portion of the trigger is accessible. The method may further include sliding a backing plate on the trigger, such that the end portion of the trigger extends through the slot in the backing plate. At this point or at a subsequent step, the backing plate may be moved sufficiently far onto the trigger to place the backing plate into abutting relation against the stop surface.

The method may also include removing a liner/cover from a side of the gasket that includes a pressure sensitive adhesive. After the liner/cover has been removed the method may include sliding the gasket (with the exposed pressure sensitive adhesive on the trigger, such that the end portion of the trigger extends through a slot in the gasket. At this point or at a latter point the method may include applying a sufficient amount of pressure to cause the pressure sensitive adhesive on the gasket to bond the gasket to the backing plate.

Once the gasket and backing plate have been mounted to the trigger, the method may include extending the end portion of the trigger through the aperture and into operative engagement with the latching mechanism on the rear side of the housing, such that the trigger is operative to cause the latching mechanism to operate, responsive at least in part to movement of the handle.

It should be appreciated that these described steps may be carried out to repair a worn out gasket. In such a case, the method may previously include steps of removing the end portion of the trigger from the aperture, and sliding the worn out gasket (and associated backing plate) off of the trigger.

In addition, it should be appreciated that a method of using the described latch assembly may include moving the handle from the extended position to the retracted position, which causes the stop surface to urge the backing plate to compress the gasket adjacent portions of the receptacle that extend around the aperture. In addition, the method of using the described latch assembly may include moving the handle from the retracted position to the extended position, which causes the trigger to cause the latching mechanism to change from a latched configuration to an unlatched configuration. Movement of the trigger via the handle may also cause the stop surface to cease urging the backing plate to compress the gasket adjacent portions of the receptacle that extend around the aperture.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A latch assembly comprising:

a housing, wherein the housing includes a front side and an opposed rear side, wherein the housing includes a receptacle on the front side of the housing, wherein the receptacle includes an aperture, a handle, wherein at least a portion of the handle extends into the receptacle, wherein the handle is operative to move between a retracted position and an extended position with respect to the receptacle, a latching mechanism mounted to the rear side of the housing, a trigger extending through the aperture, wherein the trigger is in operative connection with the handle on the front side of the housing and with the latching mechanism on the rear side of the housing, wherein the trigger is operative to cause the latching mechanism to operate, responsive at least in part to movement of the handle, a water seal system including:

a backing plate, wherein the backing plate includes a slot therethrough;

a gasket mounted to the backing plate, wherein the gasket includes a slot therethrough; and a stop surface in operative connection with at least one of the trigger or handle, or any combination thereof, wherein the backing plate and gasket are mounted to the trigger on the front side of the housing such that the trigger extends through the slots of the backing plate and the gasket in an orientation in which an end of the backing plate abuts against the stop surface, wherein the aperture includes a portion that is configured to receive therein a portion of the gasket, wherein movement of the handle from the extended position to the retracted position is operative to cause the stop surface to urge the backing plate to compress the gasket adjacent at least some portions of the receptacle that extend in surrounding relation of the aperture and the gasket portion to extend into the aperture portion.

2. The latch assembly according to claim 1, wherein the gasket is mounted to the backing plate with a pressure sensitive adhesive.

3. The latch assembly according to claim 1, wherein the latch mechanism further includes a spring, wherein the spring is in operative connection with the trigger, wherein the spring is operative to cause the handle to be biased toward the retracted position, and wherein in the retracted position, the stop surface biasingly engages the backing plate along one side edge thereof and biasingly engages the backing plate transversely of the side edge across less than an entire width of the backing plate but more than half of such entire width.

4. The latch assembly according to claim 3, wherein the slot in the backing plate extends in a portion of the backing plate that in the retracted position of the handle is disposed transversely away from the stop surface.

5. The latch assembly according to claim 1, wherein the gasket is comprised of a resilient deformable material, and wherein the slot in the gasket is sized such that the slot in the gasket is deformably engaged with the trigger and extends in surrounding relation of the trigger, and due to the engagement of the gasket with the trigger, the gasket moves with the trigger as the handle moves between the extended and retracted positions.

6. The latch assembly according to claim 5, wherein the deformable material is comprised of neoprene.

7. The latch assembly according to claim 1, wherein the trigger includes an end portion that extends through the slots of the backing plate and the gasket, wherein the trigger includes the stop surface, wherein the stop surface corresponds to a portion of the trigger that extends at an angle that is perpendicular to a direction that the end of the trigger portion extends through the slots of the backing plate and the gasket.

8. The latch assembly according to claim 7, wherein the gasket has a larger width, length, and thickness than the backing plate when the gasket is not in compressed engagement with the portions of the receptacle.

9. A method of providing a water seal system in a latch assembly that comprises a housing, wherein the housing includes a front side and an opposed rear side, wherein the housing includes a receptacle on the front side of the housing, wherein the receptacle includes an aperture, a handle, wherein at least a portion of the handle extends into the receptacle, wherein the handle is operative to move between a retracted position and an extended position with respect to the receptacle, a latching mechanism mounted to the rear side of the housing, a trigger, wherein the trigger is in operative connection with the handle on the front side of the housing, wherein the method comprises:

a) sliding a backing plate onto the trigger, such that an end portion of the trigger extends through a slot in the backing plate;

b) sliding a deformable gasket onto the trigger, such that the end portion of the trigger extends through a slot in the gasket;

c) extending the end portion of the trigger through the aperture and into operative engagement with the latch mechanism on the rear side of the housing, such that the trigger is operative to cause the latch mechanism to operate, responsive at least in part to movement of the handle, wherein the backing plate abuts a stop surface in operative connection with at least one of the trigger or handle, or any combination thereof, wherein the aperture includes a portion that is operative to receive therein a portion of the gasket, wherein movement of the handle from the extended position to the retracted position is operative to cause the stop surface to urge the backing plate to compress the gasket adjacent at least some portions of the receptacle that extend in surrounding relation of the aperture and the gasket portion to extend in the aperture portion.

10. The method according to claim 9, wherein the trigger includes the stop surface, wherein the step of sliding the backing plate onto the trigger includes sliding the backing plate into abutting engagement with the stop surface.

11. The method according to claim 10, wherein in the step of sliding the backing plate onto the trigger, the stop surface corresponds to a portion of the trigger that extends at an angle that is perpendicular to a direction that the end portion of the trigger extends through the slots of the backing plate and the gasket.

12. The method according to claim 9, wherein the gasket includes a pressure sensitive adhesive that is covered with a cover, wherein prior to the step of sliding the gasket onto the trigger, the cover is removed from the gasket; and wherein the step of sliding the gasket onto the trigger includes pressing the gasket against the backing plate to adhesively attach the gasket to the backing plate via the pressure sensitive adhesive.

13. The method according to claim 12, wherein when the gasket is being slid onto the trigger, the gasket has a larger width, length, and thickness than the backing plate when the gasket is not compressed against the portions of the receptacle.

14. The method according to claim 9, wherein in step (b) when the gasket is being slid onto the trigger and after the backing plate has been slid onto the trigger, the gasket slot is deformed in surrounding engaged relation of the trigger such that the gasket and the backing plate move together with the trigger when the handle moves between the extended and retracted positions.

15. The method according to claim 9 wherein in step (c) the stop surface engages the backing plate adjacent an edge thereof, and wherein the stop surface engages more than half but less than an entire width of the backing plate in a direction transverse of the edge, and wherein the backing plate slot extends in the backing plate away from the stop surface in a direction substantially perpendicular to the width of the backing plate.

16. The method according to claim 14, wherein the gasket slid onto the trigger in step (b) is comprised of neoprene.

17. The method according to claim 9, wherein prior to sliding the backing plate onto the trigger in step (a), end portion of the trigger is removed from the aperture, and a previously installed gasket and backing plate are slid off and out of engagement with the trigger.

18. A method of using a water seal system in a latch assembly that comprises a housing, wherein the housing includes a front side and an opposed rear side, wherein the housing include a receptacle on the front side of the housing, wherein the receptacle includes an aperture, a handle, wherein at least a portion of the handle extends into the receptacle, wherein the handle is operative to move between a retracted position and an extended position with respect to the receptacle, a latching mechanism in operative attached connection to the rear side of the housing, a trigger extending through the aperture, wherein the trigger is in operative connection with the handle on the front side of the housing and with the latching mechanism on the rear side of the housing, wherein the trigger is operative to cause the latching mechanism to operate, responsive at least in part to movement of the handle, a spring in operative connection with the trigger, wherein the spring is operative to cause the handle to be biased toward the retracted position, a water seal system including:

a backing plate, wherein the backing plate includes a slot therethrough;

a gasket mounted to the backing plate, wherein the gasket includes a slot therethrough; and a stop surface in operative connection with at least one of the trigger or handle, or any combination thereof, wherein the backing plate and gasket are mounted to the trigger on the front side of the housing such that the trigger extends through the slots of the backing plate and the gasket in an orientation in which in a retracted position of the handle, the backing plate is in biased abutting engagement with the stop surface, and a portion of the gasket extends into a portion of the aperture, wherein the method comprises:

moving the handle from the extended position to the retracted position, and responsive to the moving of the handle to the retracted position, the stop surface is caused to urge the backing plate to compress the gasket against at least some adjacent portions of the receptacle that extend in surrounding relation of the aperture and the gasket portion to extend into the aperture portion.

19. The method according to claim 18, further comprising:

moving the handle from the retracted position to the extended position such that the trigger causes the latching mechanism to change from a latched configuration to an unlatched configuration, in which the stop surface ceases to urge the backing plate to compress the gasket against the adjacent portions of the receptacle that extend in surrounding relation of the aperture and ceases causing the gasket portion to extend into the aperture.

20. The method according to claim 18, wherein the latching mechanism includes a rotary latch, wherein moving the handle from the retracted position to the extended position moves the trigger and causes movement of the rotary latch from a latched position to an unlatched position.

21. The latch assembly according to claim 1, wherein the gasket portion extends into the aperture in the retracted position of the handle from the front side toward the rear side and inwardly adjacent the portions that extend in surrounding relation of the aperture against which the gasket is compressed.

22. The latch assembly according to claim 1, wherein the latching mechanism includes a rotary latch, wherein the trigger is operative to cause the rotary latch to rotate from a latched position to an unlatched position.

23. The latch assembly according to claim 22 further comprising a linkage operatively associated with the trigger and the rotary latch, wherein the trigger is configured to operatively engage the linkage to cause the rotary latch to rotate from the latched position to the unlatched position.

24. The latch assembly according to claim 23 further including a spring operatively associated with the trigger and the linkage, wherein the spring is operative to cause the linkage to bias the trigger to move the handle toward the retracted position and cause the backing plate to compress the gasket and cause the gasket to extend into the aperture portion.

25. The latch assembly according to claim 24 wherein the slot of the gasket is offset from a center of the gasket.

* * * * *